US005482289A

United States Patent [19]

Weingardt

[11] Patent Number: 5,482,289

[45] Date of Patent: Jan. 9, 1996

[54] METHOD OF PLAYING A BINGO GAME WITH PROGRESSIVE JACKPOT

[75] Inventor: Gary Weingardt, Henderson, Nev.

[73] Assignee: Gary Weingardt Trust, a Nevada Trust, Henderson, Nev.

[21] Appl. No.: 182,850

[22] Filed: Jan. 18, 1994

[51] Int. Cl.[6] ..... A63F 3/06

[52] U.S. Cl. ..... 273/269; 273/274

[58] Field of Search ..... 273/269, 270, 273/274, 148 R, 292

[56] References Cited

U.S. PATENT DOCUMENTS

| | | | |
|---|---|---|---|
| 1,655,380 | 1/1928 | Parker | 273/269 |
| 4,019,744 | 4/1977 | Pizur, Sr. | 273/269 |
| 5,029,871 | 7/1991 | Willson, Jr. et al. | 273/269 |
| 5,127,656 | 7/1992 | Simpson | 273/269 |
| 5,160,146 | 11/1992 | Greer | 273/269 |

OTHER PUBLICATIONS

"Scarnè New Complete Guide to Gambling", pp. 205–223, 1974.

Scarne, J., *"Scarne's Complete Guide to Gambling"*, Bingo and Race Horse Keno, pp. 182–199, 432–441, 1961.

*Primary Examiner*—V. Millin
*Assistant Examiner*—William M. Pierce
*Attorney, Agent, or Firm*—John Edward Roethel

[57] ABSTRACT

A bingo card is provided having a matrix of seven columns and seven rows. Play is conducted according to the conventional manner of play of bingo, but using the seven-by-seven matrix. Because the size of the matrix has been increased, additional winning combinations are available and players can be paid for being the first player to achieve a four spot bingo, a five spot bingo, a six spot bingo, a seven spot bingo and so forth. This permits multiple winners during each round of the game of bingo and the amount of the payouts can be based on the relative difficulty of obtaining each type of winning combination. An alternative bingo card and method of play includes the designation of the sixth and seventh row and the sixth and seventh column of the seven-by-seven bingo card as distinctly demarcated sections of the bingo card, for example by using a different color or colors for these rows and columns. Players achieving a winning combination in certain specified sections of the bingo card could be paid varying amount as the payout. A progressive feature can be added to the method of play of bingo in which the player makes a separate, additional wager to be eligible for the progressive jackpot payout.

10 Claims, 6 Drawing Sheets

METHOD OF PLAYING A BINGO GAME WITH PROGRESSIVE JACKPOT

This invention relates to a bingo game, and more particularly to a bingo game that utilizes a seven-by-seven matrix card, adds progressive jackpot pools and increases the attractiveness of the game to the players.

BACKGROUND OF THE INVENTION conventional bingo is a well known game. Players are provided with bingo cards that have a matrix of five rows and five columns. The columns are lettered B I N G O from left to right across the top of the matrix and each bingo card has five numbers in each row except the center I column which has a "free space" at the intersection of the third row and the third column.

Bingo balls individually numbered 1–75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" and he wins he game.

In the conventional manner of play of bingo, in order to win the game, a player must cover five spaces in a vertical column, a horizontal row or along one of the two diagonals of the bingo card. The free space in the center of the bingo card allows a player to win with as few as four numbers being drawn. Other winning combinations include the four corners of the bingo card and the eight numbers immediately adjacent and surrounding the free space. Winning combinations can also include the covering of spots on the bingo card so that letter symbols are formed such as an X, U, L, H or T.

The operator of the bingo game will designate at the beginning of the game which particular combination or combinations of covered spots will be winning combinations for that particular game. It is also popular to play "coverall" or "blackout" games in which all of the spots on the bingo card must be covered (the twenty-four spots having numbers and the center free space) in order for the player to win.

Bingo can be played as an amusement game, but it is quite popular as a form of gambling. Players purchase bingo cards for use during the bingo session and winning players receive payouts from the operator or gaming establishment. Typically, a bingo session includes a number of individual bingo games concluding with a coverall game in which a large prize is awarded. Some operators also offer a jackpot prize if the coverall is achieved within a fixed number of called numbers, e.g. 50.

It is also known to add an extra colored bingo ball to the seventy-five numbered balls. The colored ball acts as a wild card or wild number and, if this colored ball is drawn, a player may cover any number he chooses on the bingo card.

Conventional bingo has remained relatively unchanged for many years. As legalized gaming expands into more and more jurisdictions and as Indian gaming becomes more widespread, there is a need to increase the attractiveness of bingo in order to interest more players to participate in the game.

In relative terms, bingo as it is currently conducted in gaming casinos is a low payout game. During each bingo game, numbers are drawn until a player wins, so the gaming establishment is limited in the amount of money it can award as prizes. During a regular bingo game in which the winning bingo combination is simply five covered spots in a row vertically, diagonally or horizontally, a winning player can expect to receive a $500.00 payout. The jackpot coverall game at the end of a session may pay out $1,000.00 to the winning player. If a typical bingo session has ten regular games and a single jackpot coverall game, the gaming establishment has guaranteed to pay out $6,000.00 to the players.

The revenue to the gaming establishment is based on the number of bingo cards that are bought by the players. Since the prize fund is guaranteed at a fixed amount, the more bingo cards a gaming establishment can sell, the better the profit will be.

Bingo operators have attempted to increase interest in bingo by paying larger jackpot payouts for coveralls achieved in a predetermined number of selected numbers. It takes at least twenty-four drawn numbers to achieve a coverall and typically most bingo operators select a number between fifty and fifty-five as the number of balls in which the coverall is achieved in order for the player to win the large jackpot, say $5,000.00. If a coverall is not achieved within this preset number requirement, then the payout reverts to the smaller jackpot amount, say $1,000.00, for the player who achieves the coverall.

With the advent of electronic bingo, players are able to play virtually an unlimited number of bingo cards, thus increasing their chances of hitting a bingo. With all the positive aspects of electronic bingo, it is still limited in the size and amount of the payouts that can be made since there is a cap on the total of bingo ball numbers (seventy-five) available to be chosen and a limited number of locations to hit these numbers (24 spaces). These limitations along with the free space greatly affect the amount of the jackpot prize that can currently be awarded.

There is a need to increase the player appeal of bingo in order to generate increased revenues from the operation of the game. Increased player participation would allow the payment of higher payouts which in turn would generate more player participation.

It is an object of the present invention to provide a method of playing bingo and an improved bingo card that will increase the player participation in the game.

It is a further object of the present invention to increase the popularity of bingo by increasing the difficulty factor of getting a bingo, to allow for prizes high enough to attract gamblers away from other types of gaming such as video poker, slot machines and live table games, and to compete with lotteries.

The present invention adds a degree of difficulty to bingo that increases the odds for obtaining a bingo thus allowing the gaming establishment or bingo operator to offer higher prizes. This is done by adding two columns and two rows to a standard five-by-five matrix card to create a seven-by-seven matrix card. These two additional columns can be labeled with any suitable differentiating symbols such as "E" and "S". This would create a game called BINGOES. The additional columns and rows could be demarcated separately, such as by using different colors to make the game easier to play and understand.

It is a feature of the present invention to utilize a bingo card that uses a matrix of seven rows and seven columns which will increase the difficulty of obtaining a winning combination and will also increase the types of winning combinations that can be utilized.

It is a further feature of the present invention to use different colored bingo balls so that the winning combinations can be based not only the numbers selected but also the colors of those numbers. The bingo card can also have different colored areas corresponding to the colors on the bingo balls.

It is a further feature of the present invention to provide a progressive jackpot feature to the game of bingo in which the player can become eligible for the progressive jackpot by making a separate wager.

It is an advantage of the present invention that the additional features added to the bingo game will allow more payouts to be made by the gaming establishment or the bingo operator. This will result in increased player participation and additional revenues to the gaming establishment or bingo operator.

Other objects, features and advantages of the present invention will become apparent from a consideration of the following detailed description.

SUMMARY OF THE INVENTION

A bingo card is provided having a matrix of seven columns and seven rows. A free space may be provided at the center of the matrix (at the intersection of the fourth column and the fourth row). Play is conducted according to the conventional manner of play of bingo, but using the seven-by-seven matrix. Because the size of the matrix has been increased, additional winning combinations are available and players can be paid for being the first player to achieve a four spot bingo, a five spot bingo, a six spot bingo, a seven spot bingo and so forth. This permits multiple winners during each round of the game of bingo and the amount of the payouts can be based on the relative difficulty of obtaining each type of winning combination.

An alternative bingo card and method of play includes the designation of the sixth and seventh row and the sixth and seventh column of the seven-by-seven bingo card as distinctly demarcated sections of the bingo card, for example by using a different color or colors for these rows and columns. Players achieving a winning combination in certain specified sections of the bingo card could be paid varying amount as the payout.

A progressive feature can be added to the method of play of bingo in which the player makes a separate, additional wager to be eligible for the progressive jackpot payout.

DETAILED DESCRIPTION OF THE PREFERRED EMBODIMENTS

Figure 1:
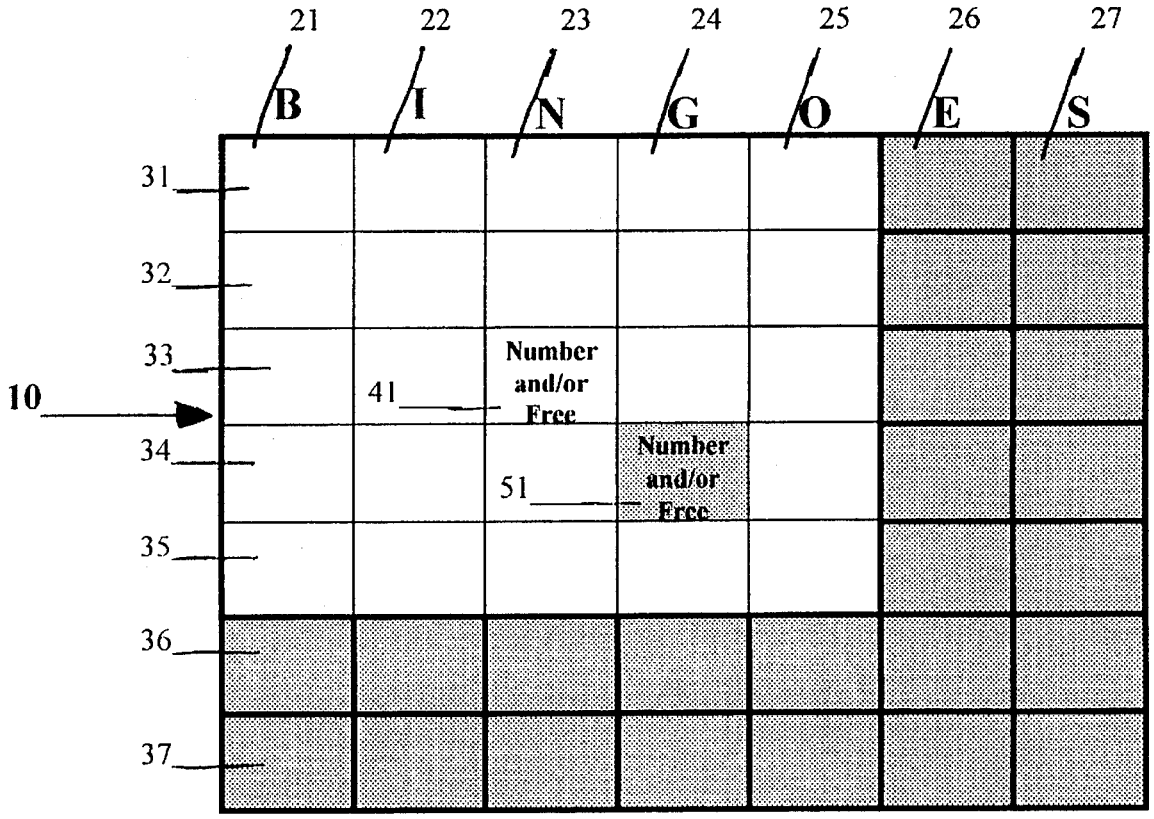
FIG. 1 shows a bingo card of the present invention.

A bingo card of the present invention is shown generally at 10 in FIG. 1. The bingo card 10 consists of a plurality of spaces that will includes numbers formed in a seven-by-seven matrix. The seven vertical columns 21, 22, 23, 24, 25, 26 and 27 each preferably include a symbol designating the column, e.g. the symbols B I N G O E S as shown in FIG. 1. The seven horizontal rows 31, 32, 33, 34, 35, 36 and 37 do not necessarily require symbols to identify the rows, although could be provided if desired.

As shown in FIG. 1, location 41 designates the intersection of the third column 23 and the third row 33. Location 51 designates the intersection of the fourth column 24 and the fourth row 34. In the preferred embodiment of the present invention, the sixth column 26, seventh column 27, sixth row 36 and seventh row 37 are demarcated differently from the other rows and columns. For example, the sixth column 26, seventh column 27, sixth row 36 and seventh row 37 could be printed with a red background while the remaining rows and columns could simply have a white background. Any distinguishing colors could be used or other forms of separate demarcation could also be used, such as shading, cross-hatching or similar ways of showing separate demarcation.

The two additional columns and the two additional rows would increase the amount of numbers in the number pool of bingo balls from 75 to 147 which could be disbursed to the respective bingo card columns as shown by the following table:

| B | I | N | G | O | E | S |
|---|---|---|---|---|---|---|
| 1 | 22 | 43 | 64 | 85 | 105 | 127 |
| T | T | T | T | T | T | T |
| H | H | H | H | H | H | H |
| R | R | R | R | R | R | R |
| U | U | U | U | U | U | U |
| 21 | 42 | 63 | 84 | 105 | 126 | 147 |

The bingo card 10 shown in FIG. 1 could be used in the play of a variety of variations of conventional bingo. The entire seven-by-seven matrix card could be used to play the game of bingo and a player would be paid for covering spots corresponding to called bingo balls according to one or more of the following winning combinations: a straight line of seven numbers in a row either vertically, horizontally or diagonally; the four corners; the inside rectangle comprising the eight spots around the center free space 51, the outside rectangle comprising the twenty-four spots around the perimeter of the bingo card 10 or the intermediate rectangle comprising the sixteen spots between the inside rectangle and the outside rectangle. The operator can designate payout amounts based on the degree of difficulty of obtaining one or more of these various winning combinations.

Alternatively, two contemporaneous bingo games could be run simultaneously using the same bingo card. A conventional five-by-five matrix game could be called using that portion of the bingo card 10 comprising columns 21, 22, 23, 24 and 25 and rows 31, 32, 33, 34 and 35. For this game, the free space would be designated at space 41. The same bingo card 10 could be used for the seven-by-seven matrix game described above in which all seven columns and rows are active and the free space is designated at space 51. Play continues until one player achieves a winning combination in the five-by-five matrix game and one player achieves a winning combination in the seven-by-seven matrix game. To make it even more difficult to win, it could be required that the winning player have both the five-by-five matrix game winner and the seven-by-seven matrix game winner on the same bingo card. The operator can designate payout amounts based on the degree of difficulty of obtaining either a five-by-five matrix game winning combination, a seven-by-seven matrix game winning combination or both.

Another alternative method of play using the bingo card 10 shown in FIG. 1 is to provide different payouts to the player depending on what locations of the bingo card 10 are used to form the winning combinations. In the preferred embodiment described above in column 26, column 27, row 36 and row 37 are shaded in the color red and the remaining rows and columns are shaded in the color white, a player could be paid a higher payout if he achieved an "all red" bingo instead of a mixed red and white bingo.

It is also contemplated to use separate and distinct markings on the bingo balls, themselves, to differentiate some of the bingo balls from other of the bingo balls. For example, some of the bingo balls could be colored red and the remainder of the bingo balls colored white, in addition to the individual letters and numbers each bingo ball has marked thereon.

Figure 2:
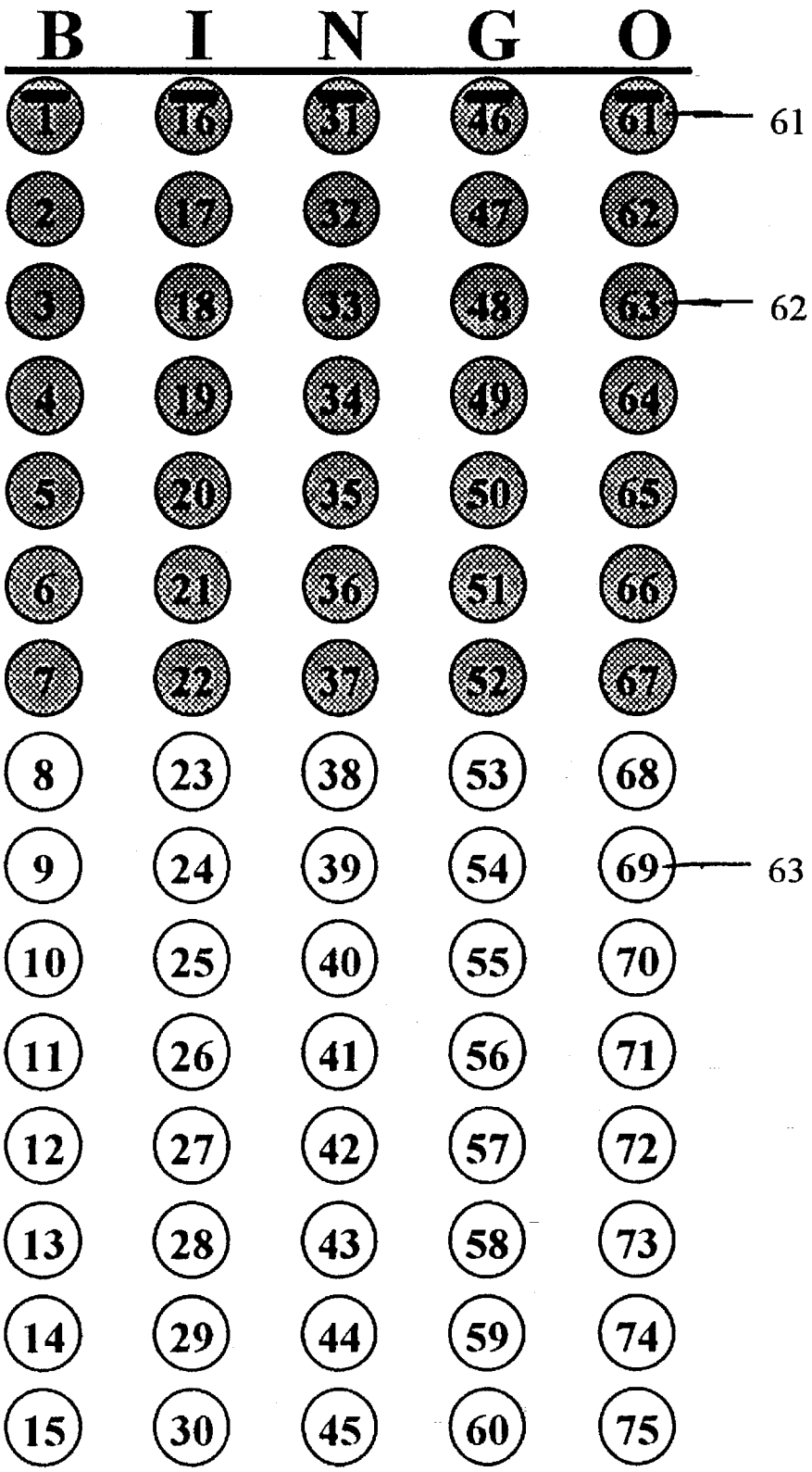
FIG. 2 shows a chart of bingo balls used in the method of the present invention.

FIG. 2 shows a chart 100 of all seventy-five of the bingo balls that would be used in a five-by-five matrix game. In this preferred embodiment of the present invention, some of the bingo balls as shown at 63 are colored white (for example, balls numbered 8–15, 23–30, 38–45, 53–60 and 68–75), some of the bingo balls as shown at 62 are colored red (for example, balls numbered 2–7, 17–22, 32–37, 47–52 and 62–67) and some of the bingo balls as shown at 61 are colored red with a black stripe (balls numbered 1, 16, 31, 46 and 61).

Various payouts can be made to the player depending on whether the player achieves an all white bingo, an all red bingo, an all red with black stripes bingo or a mixed bingo.

The same principle can be applied to the seven-by-seven matrix game.

The method of the present invention can include a progressive jackpot feature. A player makes a wager and receives a bingo card of the type shown in FIG. 1. The player is then eligible to participate in a five-by-five matrix game and the player uses only the five-by-five portion of the bingo card for this game. The player makes a second, separate wager that goes into a separate pool and the player is eligible for the seven-by-seven matrix game. As money is wagered by players participating in the seven-by-seven matrix game, the size of the payout that a player can win in the seven-by-seven game can increase progressively.

If desired by the gaming establishment or the bingo operator, both the five-by-five matrix game and the seven-by-seven matrix game can be run as progressive jackpot payouts. The player may be eligible for the progressive payouts by making a third separate wager. Portions of the third wager are designated to separate pools. Separate pools can include jackpot pools, future pools and lower payout pools.

Figure 3:
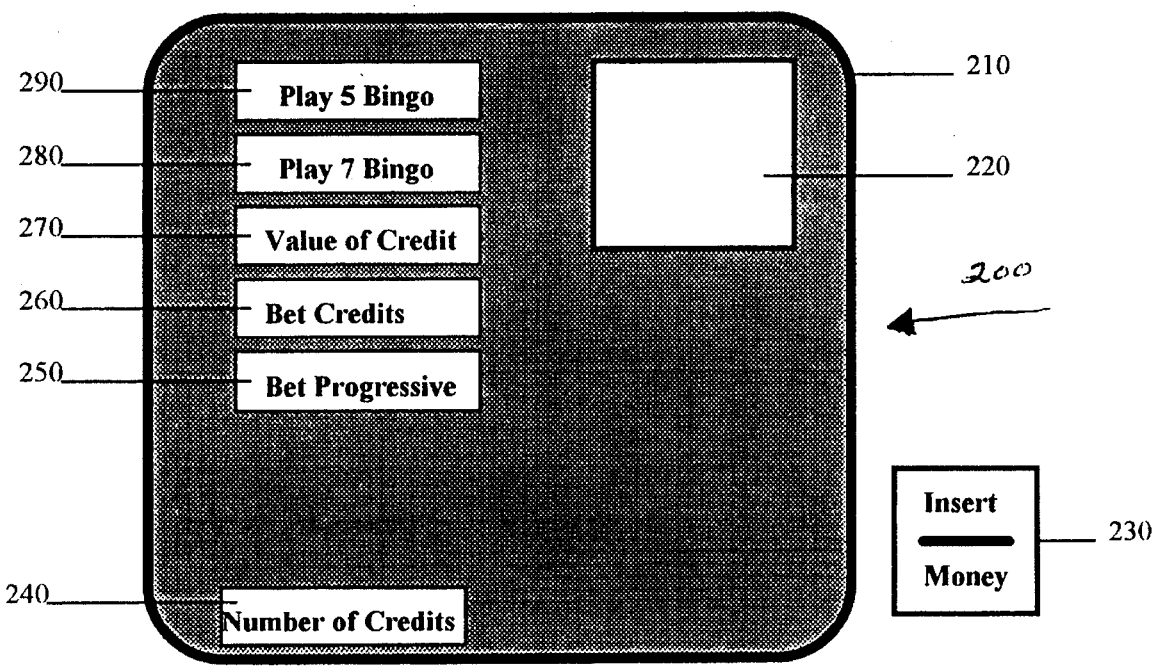
FIG. 3 shows a schematic layout for an electronic bingo game using the bingo card and method of play of the present invention.

FIG. 3 shows a schematic layout of an electronic bingo game that uses the bingo card and the method of play of the present invention. An electronic gaming machine 200 is provided with a video screen 210. The video screen 210 has a location 220 in which the bingo card is displayed to the player. The video screen also can include displays that provide other information to the player, such as a display 240 that shows the number of credits accrued to the player, a touch panel 250 to allow the player to make a progressive bet, a touch panel 260 to allow the player to bet one or more of his accrued credits, a display 270 that shows the monetary value per credit, a touch panel 280 to allow the player to play the seven-by-seven matrix bingo card and a touch panel 290 to allow the player to play the five-by-five matrix bingo card. A bill acceptor or coin acceptor 230 is also provided to allow the player to activate the gaming machine 200.

Figure 4:
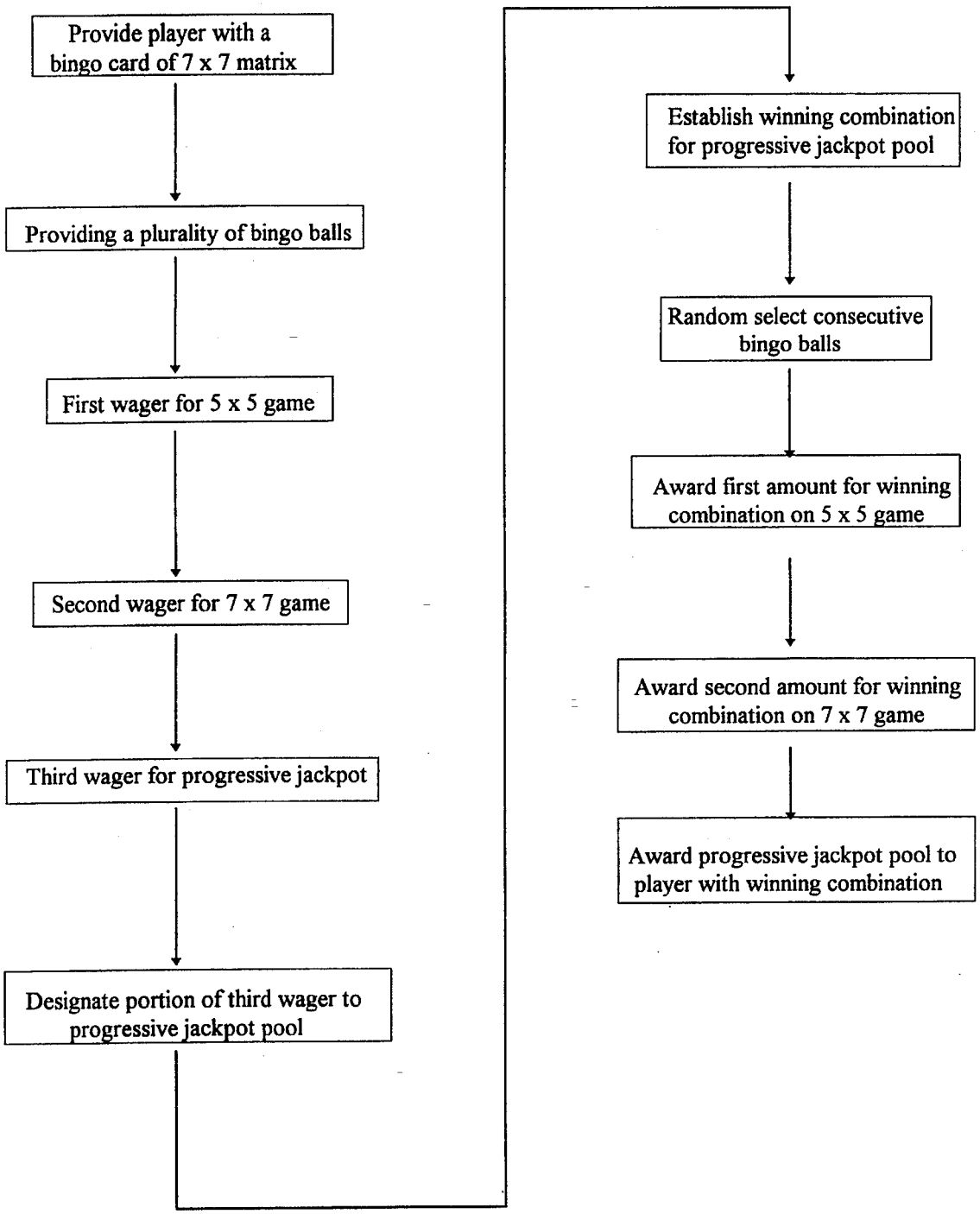
FIG. 4 shows a flow chart depicting a method of play of the present invention.

FIG. 4 is a flow chart that depicts the method of play of a preferred embodiment of the present invention. In this flow chart, the player is provided with a bingo card having a 7×7 matrix and a plurality of bingo balls are provided forming the selection pool. The player makes a first wager to be eligible for a game of bingo played using the 5×5 portion of the bingo card and a second wager to be eligible to play the a game of bingo using the 7×7 portion of the bingo card. The player also makes a third wager to be eligible for the progressive jackpot to which a portion of the third wager is designated.

A winning combination is established for the progressive jackpot pool and bingo balls are randomly selected. The player is awarded a first amount if he achieves a winning combination on the 5×5 game, a second amount if he achieves a winning combination in the 7×7 game and the progressive jackpot pool if he achieves the winning combination for the progressive jackpot.

Figure 5:
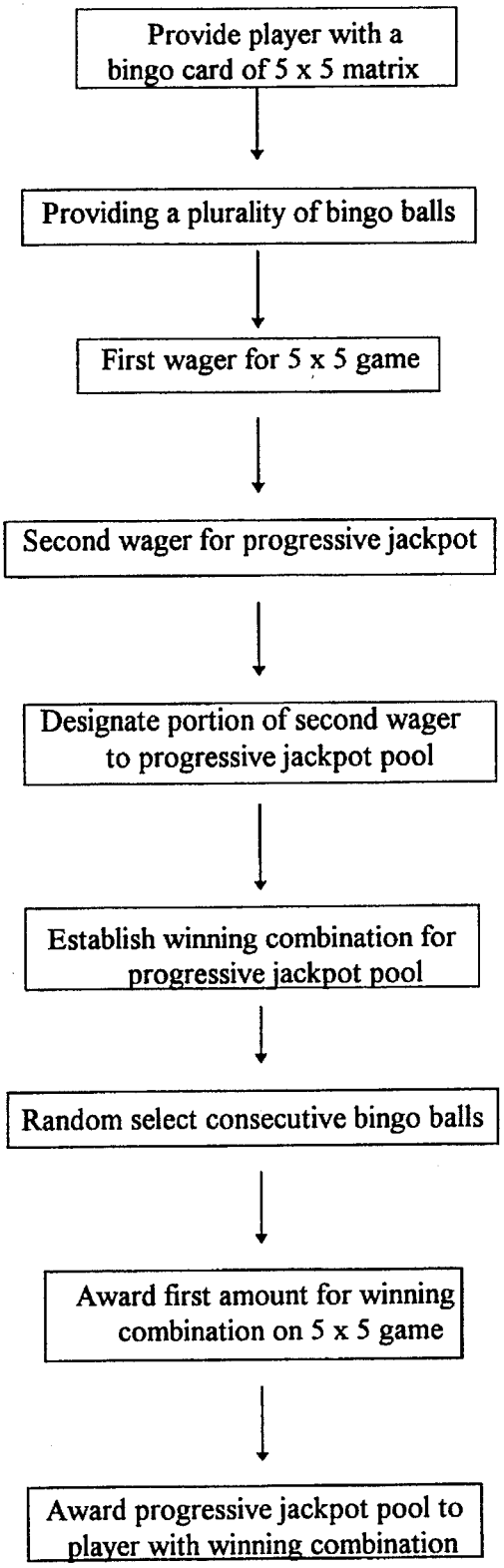
FIG. 5 shows a flow chart depicting an alternative method of play of the present invention.

FIG. 5 is a flow chart that depicts the method of play of an alternative preferred embodiment of the present invention. In this flow chart, the player is provided with a bingo card having a 5×5 matrix and a plurality of bingo balls are provided forming the selection pool. The player makes a first wager to be eligible for a game of bingo played using the 5×5 matrix of the bingo card and a second wager to be eligible for the progressive jackpot to which a portion of the second wager is designated.

A winning combination is established for the progressive jackpot pool and bingo balls are randomly selected. The player is awarded a first amount if he achieves a winning combination on the 5×5 game and the progressive jackpot pool if he achieves the winning combination for the progressive jackpot.

Figure 6:
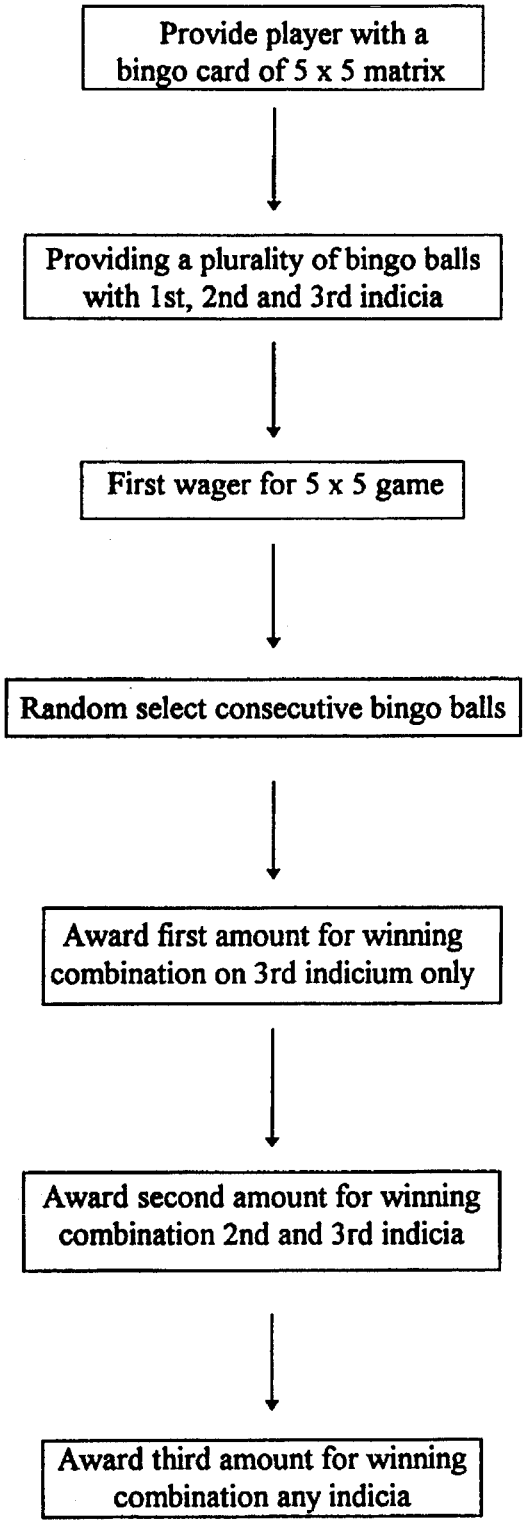
FIG. 6 shows a flow chart depicting another alternative method of play of the present invention.

FIG. 6 is a flow chart that depicts the method of play of another alternative preferred embodiment of the present invention. In this flow chart, the player is provided with a bingo card having a 5×5 matrix and a plurality of bingo balls are provided forming the selection pool. The bingo balls have first, second and third indicia separating the bingo balls into three distinct groups.

The player makes a wager to be eligible for a game of bingo played using the 5–5 matrix of the bingo card and bingo balls are randomly selected. The player is awarded a first amount if he achieves a winning combination on the 5×5 game using only balls having the third indicium, the player wins a second amount if he achieves a winning combination on the 5×5 game using balls having either the second or third indicium and the player wins a third amount if he achieves a winning combination on the 5×5 game using balls having any indicia.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. The method of playing a game of bingo comprising:

a) providing a player with a bingo card consisting essentially of:

1) a plurality of numbered spaces formed as a matrix having seven rows and seven columns;

2) a first indicium designating a portion of the matrix comprising five contiguous rows and five contiguous columns whereby a five-by-five bingo game can be played thereon; and 3) a second indicium designating a portion of the matrix comprising two contiguous rows and two contiguous columns whereby, when combined with the first indicium, a seven-by-seven bingo game can be played thereon;

b) providing a plurality of bingo balls each having individual numbers corresponding to the numbered spaces on the bingo card;

c) a player making a first wager to be eligible for the five-by-five bingo game and a second wager to be eligible for the seven-by-seven bingo game;

d) randomly selecting consecutive bingo balls;

e) awarding a first preselected amount when the player achieves a predetermined winning combination on the five-by-five matrix of the bingo card;

f) awarding a second preselected amount when the player achieves a predetermined winning combination on the seven-by-seven matrix of the bingo card;

g) a player making a third wager to be eligible for a progressive jackpot;

h) designating a portion of the third wager to a separate progressive jackpot pool;

i) establishing a predetermined combination as a winning combination for the progressive jackpot pool; and j) awarding the progressive jackpot pool to the player when he achieves the predetermined winning combination on the bingo card.

2. The method of playing a game of bingo comprising:

a) providing a player with a bingo card having a plurality of numbered spaces formed as a matrix having five rows and five columns used in the play of a five-by-five bingo game;

b) providing a plurality of bingo balls each having individual numbers corresponding to the numbered spaces on the bingo card;

c) a player making a first wager to be eligible for the five-by-five bingo game, d) a player making a second wager to be eligible for a progressive jackpot;

e) randomly selecting consecutive bingo balls;

f) awarding a first preselected amount when the player achieves a predetermined winning combination on the five-by-five matrix of the bingo card;

g) designating a portion of the second wager to a separate progressive jackpot pool;

h) establishing a predetermined combination as a winning combination for the progressive jackpot pool; and i) awarding the progressive jackpot pool to the player when he achieves the predetermined winning combination on the bingo card.

3. The method of playing a game of bingo comprising:

a) providing a player with a bingo card having a plurality of numbered spaces formed as a matrix having five rows and five columns used in the play of a five-by-five bingo game;

b) providing a plurality of bingo balls each having individual numbers corresponding to the numbered spaces on the bingo card, the plurality of bingo ball further comprising a first group of the plurality of bingo balls are marked with a first indicium, a second group of the plurality of bingo balls are marked with a second indicium and a third group of the plurality of bingo balls are marked with a third indicium;

c) a player making a wager to be eligible for the five-by-five bingo game, e) randomly selecting consecutive bingo balls;

f) if the player achieves a predetermined winning combination on the bingo card when only bingo balls have been selected having the third indicium, awarding the player a first preselected amount;

f) if the player achieves a predetermined winning combination on the bingo card when only bingo balls have been selected having the second or third indicium, awarding the player a second preselected amount; and f) if the player achieves a predetermined winning combination on the bingo card when bingo balls have been selected having the either the first, second or third indicium, awarding the player a third preselected amount.

4. The method of claim 3 wherein the first indicium is a first color, the second indicium is a second color and the third indicium is a stripe.

5. The method of playing a game of bingo comprising:

a) providing a player with a bingo card having a plurality of numbered spaces formed as a matrix used in the play of a bingo game;

b) providing a plurality of bingo balls each having individual numbers corresponding to the numbered spaces on the bingo card;

c) a player making a first wager to be eligible for the bingo game, d) a player making a second wager to be eligible for a progressive jackpot;

e) randomly selecting consecutive bingo balls;

f) awarding a first preselected amount when the player achieves a predetermined winning combination on the matrix of the bingo card;

g) designating a portion of the second wager to a separate progressive jackpot pool;

h) establishing a predetermined combination as a winning combination for the progressive jackpot pool; and i) awarding the progressive jackpot pool to the player when he achieves the predetermined winning combination on the bingo card.

6. The method of claim 5 wherein the plurality of bingo balls are divided into groups in which a first group are marked with a first indicium and a second group are marked with a second indicium.

7. The method of claim 6 in which the first indicium is a first color and the second indicium is a second color.

8. The method of claim 7 in which the predetermined winning combination for the progressive jackpot pool is established as a bingo achieved from balls drawn having all the same color.

9. The method of playing a game of bingo comprising:

a) providing a player with a bingo card having a plurality of numbered spaces formed as a matrix used in the play of a bingo game;

b) providing a plurality of bingo balls each having individual numbers corresponding to the numbered spaces on the bingo card, the plurality of bingo ball further comprising a first group of the plurality of bingo balls are marked with a first indicium, a second group of the plurality of bingo balls are marked with a second indicium and a third group of the plurality of bingo balls are marked with a third indicium;

c) a player making a wager to be eligible for the bingo game, e) randomly selecting consecutive bingo balls;

f) if the player achieves a predetermined winning combination on the bingo card when only bingo balls have been selected having the third indicium, awarding the player a first preselected amount;

f) if the player achieves a predetermined winning combination on the bingo card when only bingo balls have been selected having the second or third indicium, awarding the player a second preselected amount; and f) if the player achieves a predetermined winning combination on the bingo card when bingo balls have been selected having the either the first, second or third indicium, awarding the player a third preselected amount.

10. The method of claim 9 wherein the first indicium is a first color, the second indicium is a second color and the third indicium is a stripe.

* * * * *